US005667430A

United States Patent [19]

McPhee et al.

[11] Patent Number: 5,667,430

[45] Date of Patent: Sep. 16, 1997

[54] BOLT HEAD BLASTER

[75] Inventors: William S. McPhee, Arlington; Anh Nguyen, Herndon, both of Va.

[73] Assignee: LTC Americas Inc., Sterling, Va.

[21] Appl. No.: 519,163

[22] Filed: Aug. 25, 1995

[51] Int. Cl.[6] ..... B24C 1/00

[52] U.S. Cl. ..... 451/87; 451/75; 451/102; 451/456

[58] Field of Search ..... 457/456, 77, 87, 457/89, 102, 75

[56] References Cited

U.S. PATENT DOCUMENTS 2,846,822 8/1958 Steffen ..... 451/87

2,868,509 1/1959 Williams ..... 451/87

3,545,996 12/1970 Dungan ..... 451/87

3,715,838 2/1973 Young et al. ..... 451/87

*Primary Examiner*—Eileen P. Morgan

*Attorney, Agent, or Firm*—Lane, Aitken & McCann

[57] ABSTRACT

A blast head for a vacuum-blasting machine has a deflecting surface oriented at an angle to the direction in which particles under pressure are sent through the blast head. The blast head has an inner, blast jacket, an outer, vacuum jacket, and a blast head body connected to the vacuum jacket by a flexible bellows. The blast head body is secured to the blast jacket to permit axial movement of the blast jacket relative to the vacuum jacket.

17 Claims, 4 Drawing Sheets

BOLT HEAD BLASTER

BACKGROUND OF THE INVENTION

The present invention relates to vacuum blasting, and more particularly, to a blast head for a sealed waste transfer system for vacuum-blasting machines using recyclable abrasives.

As will be appreciated by those skilled in the art, vacuum blasting refers to an improved technology for cleaning and preparing surfaces by blasting the surface with abrasive particles entrained in a relatively high velocity air stream. In vacuum blasting, a small hood surrounds the blasting nozzle, and a vacuum port within the hood, adjacent the nozzle, sucks up the abrasive particles and debris loosened from the surface being blasted. This abrasive particle and debris mixture passes through a hose to a separator, where the debris is separated from the abrasive particles. The separated debris is deposited in a closed waste chamber, which is maintained below atmospheric pressure during the blasting operation. Abrasive particles separated from the debris are returned to a hopper and used again in the blasting operation. Vacuum-blasting machines provide closed-system blasting by making the blast head in effect a small containment structure. Coating and/or corrosion materials removed from the surface being treated and spent abrasive particles are deposited in a closed waste chamber. In operation, the system is virtually dust free and, therefore, relatively safe for the operator and the environment, even when used to blast surfaces covered with potentially hazardous materials, such as lead and radioactive contaminants.

Although the blast heads for such vacuum-blasting systems are generally satisfactory for cleaning large surfaces, they are less than satisfactory for cleaning the sides of bolts, nuts and other elements that project from larger surfaces.

SUMMARY OF TEE INVENTION

An object of this invention is the provision for a vacuum blasting machine of a bolt head blaster which does a thorough job of cleaning the sides of bolts, nuts and other elements that project from larger surfaces.

In order to achieve this and other objects of the present invention, the blast head is provided with an internal deflection surface for directing particles under pressure against sides of projecting elements which lie in planes generally parallel to the direction in which the particles are sent through most of the blast head. The deflection surface is a surrounding surface of, for example, annular, or square or other polygonal shape positioned at an open end of a blast jacket which is mounted for axial movement relative to an outer vacuum jacket. The deflection surface is made of a material with greater abrasive wear characteristics than the material of the blast jacket and is defined on an insert or sill secured to an end of the blast jacket adjacent to a work surface.

The blast jacket is mounted for axial movement relative to the vacuum jacket so that the deflection surface can be moved axially to direct abrasive particles to every area along the longitudinal axis of the projection. In order to enable movement between the blast jacket and the vacuum jacket, a portion of the blast jacket distal to the open end is received within and secured to a blast head body, which can be held by an operator of the vacuum-blasting machine. The blast head body is connected by a flexible bellows to a rear end of the vacuum jacket which is remote from the work surface. Guide elements may be positioned between the blast jacket and the vacuum jacket to provide smooth axial movement between the two jackets.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENT

Figure 1:
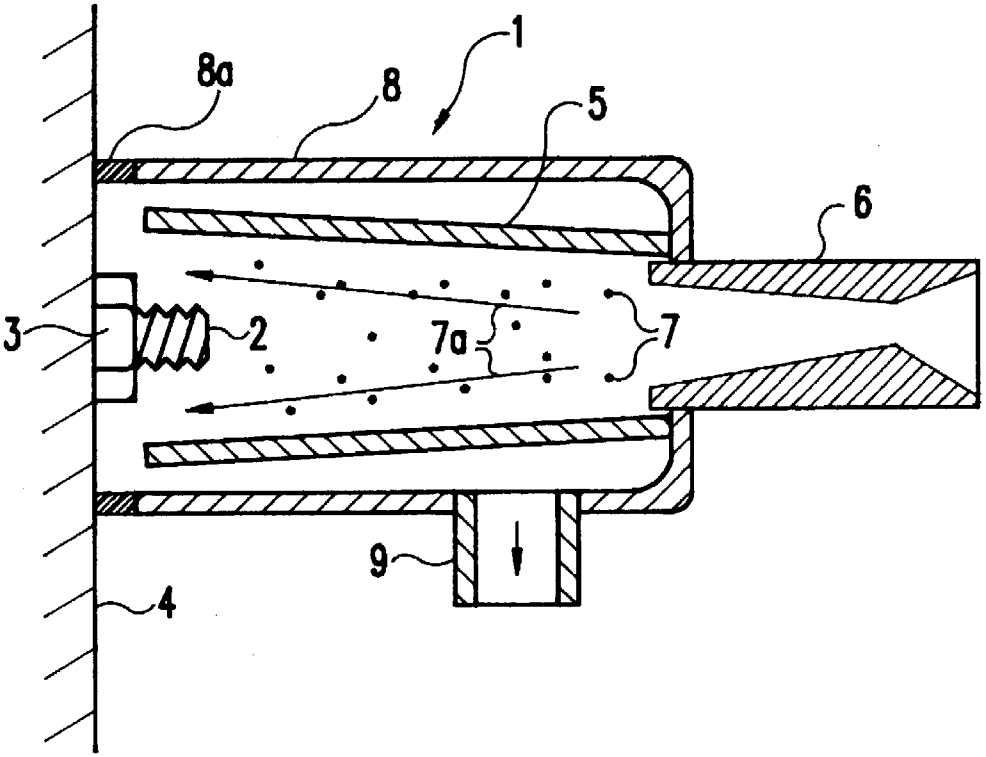
FIG. 1 PRIOR ART
FIG. 1 is a schematic axial cross section through a known vacuum blast head.

As can be seen from FIG. 1, a prior art blast head, indicated generally by the reference numeral 1, is being used to clean a bolt 2 and a nut 3 projecting from larger planar surface 4. The planar surface is typically a member of a bridge, building, ship or the like. The blast head 1 includes a blast jacket 5, a nozzle 6 feeding abrasive particles 7 in a stream of compressed air through the blast jacket for engagement with the surface to be cleaned, a vacuum jacket 8 surrounding the blast jacket, and a takeoff 9 in the vacuum jacket, connected to a vacuum source, for recovering the abrasive particles and debris removed from the work surface. The general trajectory of the particles 7 is indicated by the arrows 7*a*. A seal 8*a* of rubber or other material is secured at a forward end of the vacuum jacket 8 for engaging a work surface and preventing the escape of abrasive particles 7. Although such prior art nozzles do a satisfactory job of cleaning larger, generally planar surfaces, such as the surface 4, they do not do a satisfactory job of cleaning the side surfaces of bolts, nuts, and other projections.

Figure 2:
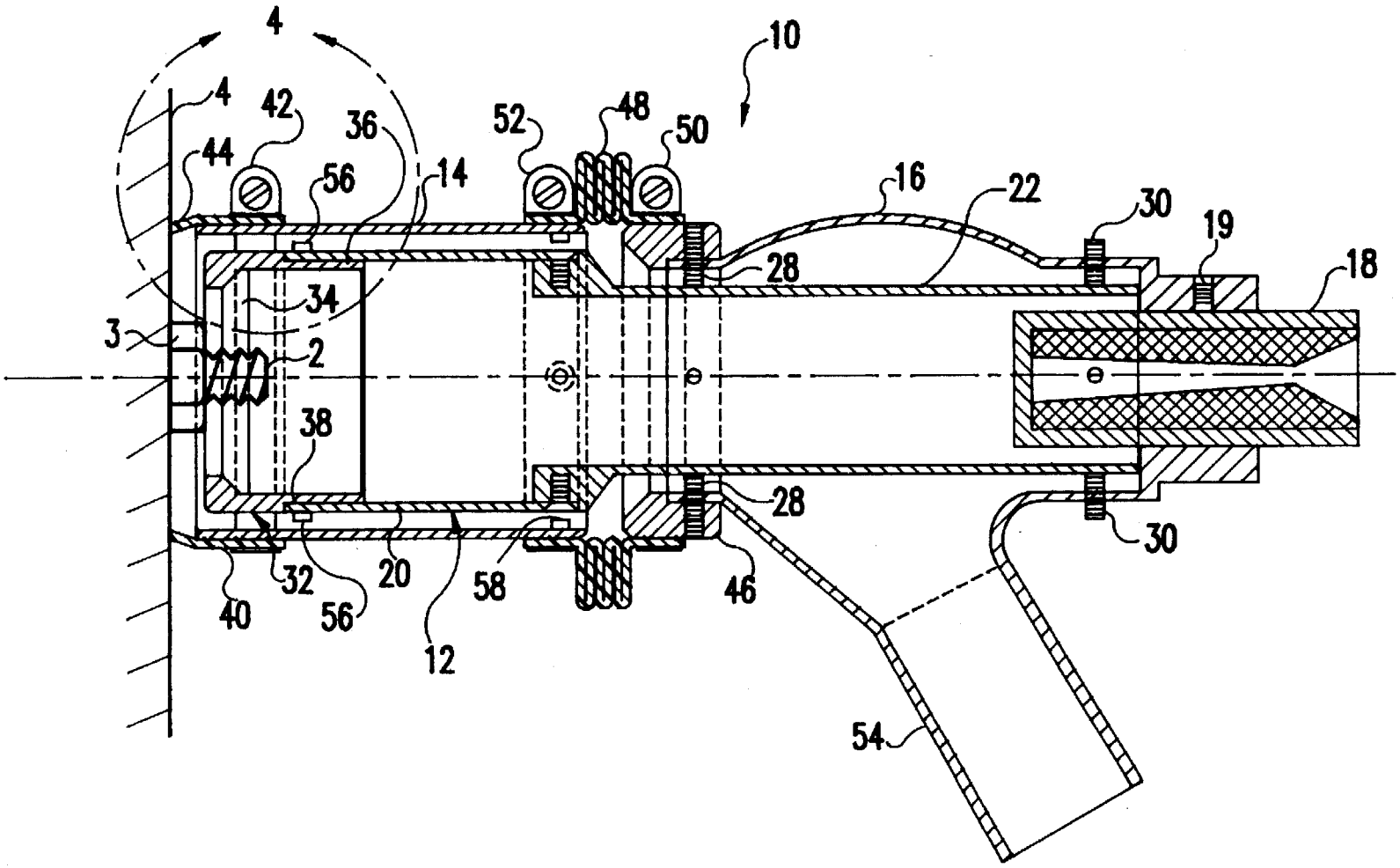
FIG. 2 is an axial cross section through a blast head according to the present invention.
Figure 3:
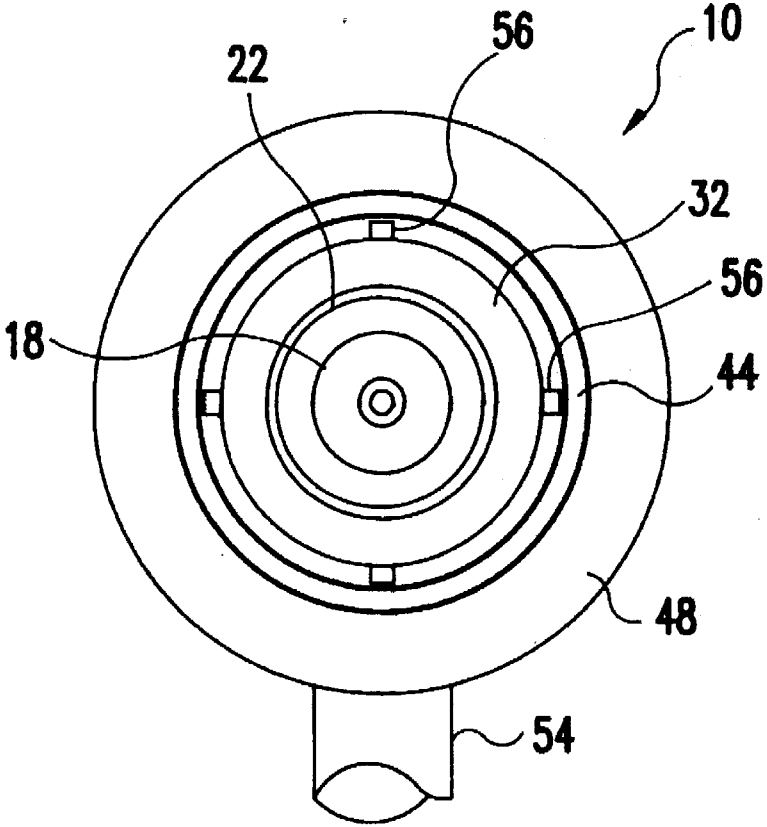
FIG. 3 is a left end view of the blast head of FIG. 2.

As can be seen from FIGS. 2 and 3, the blast head according to the present invention, which is designated generally by the reference numeral 10, includes a blast jacket 12, a vacuum jacket 14 surrounding the blast jacket, and a blast head body 16 in which a nozzle 18 is secured by, for example, a socket set screw 19. The nozzle 18 is connected to a source of abrasive particles, such as steel grit, aluminum oxide, or walnut shells, entrained in a stream of compressed air. The blast jacket 12 comprises a forward blast tube 20 adjacent to the bolt 2 and the nut 3 or other projection, and a rear blast tube 22 connected to the blast head body 16. A rear end of the forward blast tube 20 is positioned around a connection formation 24 at a forward end of the rear blast tube 22 and secured thereto, such as by circumferentially spaced screws 26. The rear blast tube 22 is secured to the blast head body 16, such as by a forward set of circumferentially spaced socket set screws 28 at a forward end of the blast head body 16 and by a rear set of circumferentially spaced socket set screws 30 adjacent to a rear end of the blast head body.

Figure 4:
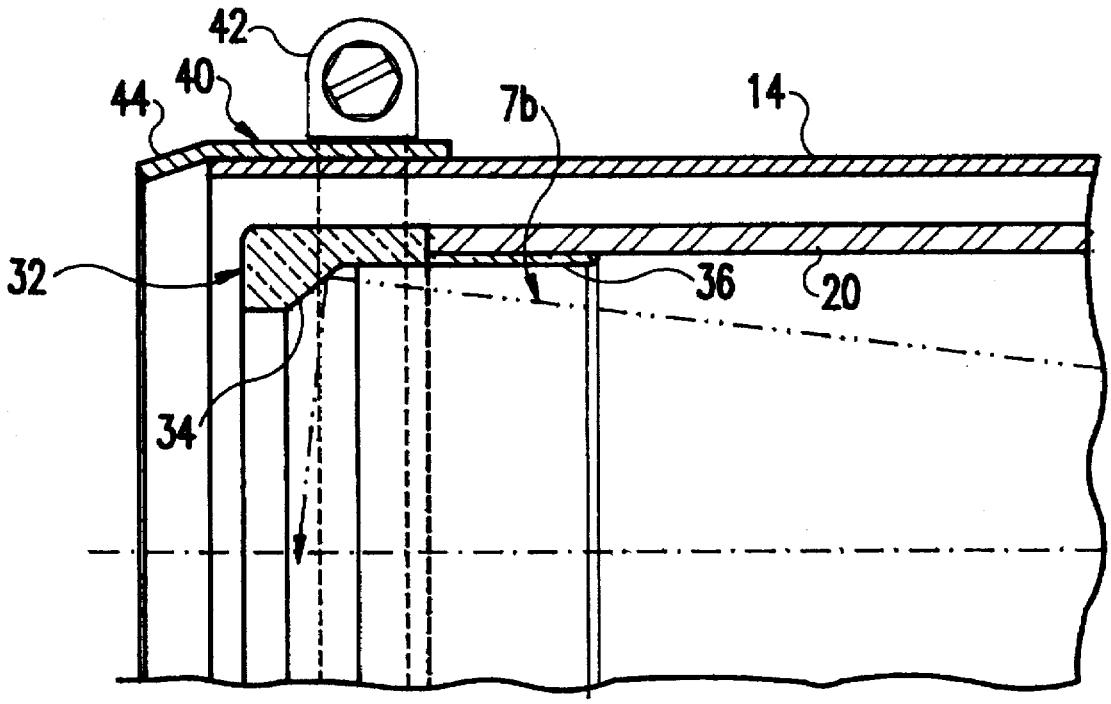
FIG. 4 is an enlarged cross section of a fragment of the blast head of FIG. 2 within the circle 4.

As can best be seen from FIGS. 2 and 4, an annular sill or insert ring 32 is secured in a forward end of the blast jacket 12, the insert ring having an annular deflecting surface 34 oriented at an angle with respect to the longitudinal axis of the blast jacket for deflecting the stream of compressed air and abrasive particles toward the side surfaces of the bolt 2 and the nut 3. The general trajectory of the abrasive particles 7 is indicated by the arrow 7*b*. It has been found that an annular deflecting surface 34 oriented at 45 degrees to the longitudinal axis of the blast jacket 12 provides satisfactory cleaning of the side surfaces of the bolt 2 and the nut 3 and other projections. However, it is contemplated that other angles can be used for the deflecting surface 34, such as other angles in the range of about 30° to about 80° to the longitudinal axis of the blast jacket 12.

The insert ring 32, including the deflecting surface 34, is made of a material, such as tungsten carbide or boron carbide, which is highly resistant to abrasive material. In the embodiment shown, the insert ring 32 has a rearwardly extending annular flange 36, which is received in a forward end of the blast jacket 12, and a shoulder 38, which engages the forward end of the blast jacket 12. The insert ring 32 has an outer diameter equal to the outer diameter of the forward blast tube 20. Although the insert ring 32 is described as annular, it can have other closed-loop shapes, such as square or other polygonal shapes.

A sealing collar 40 of, for example, elastomeric material is secured around the open end of the vacuum jacket 14 by a conventional hose clamp 42 or other suitable arrangement. The sealing collar 40 includes a conical portion 44 projecting axially beyond the open end of the vacuum jacket 14 and radially inward. The conical portion 44 engages the work surface and provides a seal between the work surface and the vacuum jacket 14 to prevent the escape of abrasive particles 7 and debris and to allow the abrasive particles and debris to be removed by the vacuum source and separated from one another. The sealing collar 40 can be made of material other than elastomeric material, for example, brush material.

An arrangement is provided to permit the deflecting surface 34 to move relative to the vacuum jacket 14 and, thereby, clean evenly the entire axial length of the side surfaces of the bolt 2 and the nut 3. The arrangement includes an adapter ring 46 encircling a forward end of the blast head body 16, the adapter ring being held in place by the socket set screws 28, which are received in radial apertures 47 in the adapter ring. The adapter ring 46 is connected to the rear end of the vacuum jacket 14 by a flexible bellows 48. The flexible bellows 48 permits axial movement of the blast head body 16 and, thus, the blast jacket 12 relative to the vacuum jacket 14 while maintaining the integrity of a vacuum chamber from which the abrasive particles 7 and debris can be recovered. One end of the flexible bellows 48 is positioned around the adapter ring 46 and secured to the adapter ring by a clamp 50, and the other end of the flexible bellows is positioned around and secured to the rear end of the vacuum jacket 14 by a clamp 52. From the position shown in FIG. 2, in which the flexible bellows 48 is compressed, the blast head body 16 can be moved rearward while the sealing collar 40 on the vacuum tube 14 is kept in contact with the work surface. As a result, the flexible bellows 48 expands axially, and the deflecting surface moves axially along the bolt 2 and the nut 3. At the same time, an annular vacuum passage is maintained between the blast jacket 12, on the inside, and the vacuum jacket 14, the flexible bellows 48, and the blast head body 16, on the outside. The annular vacuum passage is connected to a vacuum source through a takeoff 54 in the blast head body 16.

The blast jacket 12 may be kept centered inside the vacuum jacket 14 and guided for axial movement therein by small projecting guides, which can be cylindrical in shape. First guide projections 56 project toward the vacuum jacket 14 from the blast jacket 12, at a forward end of the forward blast tube 20, and second guide projections 58 extend toward the blast jacket 12 from a rear end of the vacuum jacket 14. The first guide projections 56 are circumferentially spaced from one another, the second guide projections 58 are circumferentially spaced from one another. The first and second guide projections 56 and 58 can be secured to the blast jacket 12 and the vacuum jacket 14, respectively, by welding.

Figure 5:
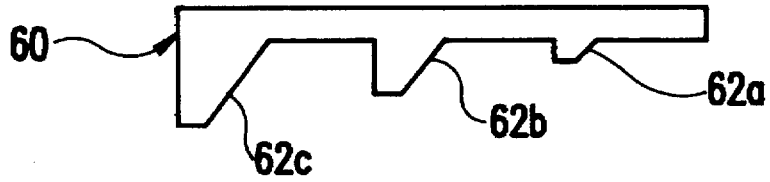
FIG. 5 is an enlarged cross section of a fragment of an alternate form of annular insert according to the present invention.

One alternative form of an annular insert can be appreciated from FIG. 5. The annular insert 60 includes a series of axially-spaced deflecting surfaces **62*a*, 62*b* and 62*c*, the deflecting surfaces closer to the work surface projecting progressively farther radially inward. The particles 7 are deflected from each of the axially-spaced deflecting surfaces 62*a*, 62*b* and 62*c* in the same general trajectories as indicated by the arrow 7*b* for the deflecting surface 34 in FIG. 4**.

While the invention has been described in terms of a single preferred embodiment, those skilled in the art will recognize that the invention can be practiced with modification within the spirit and scope of the appended claims. For example, the adapter ring 46 can be made in one piece with the blast head body 16.

Having thus described my invention, what I claim as new and desire to secure by Letters Patent is as follows:

1. A blast head for a vacuum-blasting machine cleaning sides of elements projecting from larger surfaces, comprising:

a vacuum jacket for engaging a surface from which an element projects, said vacuum jacket being connected to a vacuum source to conduct particles away from the surface;

a blast jacket positioned within said vacuum jacket, said blast jacket having an open end for receiving the projecting elements;

means for sending particles under pressure in predetermined directions through said blast jacket and into engagement with the projecting elements; and means for directing particles under pressure against sides of the projecting elements lying at angles relative to a plane transverse to the direction in which particles are sent through the blast jacket.

2. The blast head of claim 1, wherein said directing means comprises a deflection surface oriented at an angle to said predetermined directions in which particles are sent under pressure.

3. The blast head of claim 2, wherein said deflection surface is an annular surface positioned at the open end of said blast jacket.

4. The blast head of claim 2, wherein said blast jacket defines a longitudinal axis, and said deflection surface lies at a 45° angle with respect to said longitudinal axis.

5. The blast head of claim 2, wherein said deflection surface is made of tungsten carbide.

6. The blast head of claim 2, wherein said deflection surface is made of boron carbide.

7. A blast head for a vacuum-blasting machine for cleaning sides of elements projecting from larger surfaces, comprising:

a vacuum jacket for engaging a surface from which an element projects, said vacuum jacket being connected to a vacuum source to conduct particles away from the surface;

a blast jacket positioned within said vacuum jacket, said blast jacket having an open end for receiving the projecting elements;

means for sending particles under pressure in predetermined directions through said blast jacket and into engagement with the projecting elements; and means for directing particles under pressure against sides of the projecting elements lying at angles relative to a plane transverse to the direction in which particles are sent through the blast jacket, wherein said vacuum jacket defines a longitudinal axis, the blast head further comprising means for connecting said blast jacket to said vacuum jacket for movement relative to said vacuum jacket in a direction parallel to the longitudinal axis of said vacuum jacket.

8. The blast head of claim 7, wherein said connecting means comprises an annular member encircling and fixed to said blast jacket, and a flexible bellows positioned between and connected to said annular member and said vacuum jacket.

9. The blast head of claim 7, further comprising means for guiding the movement of said blast jacket relative to said vacuum jacket in a direction parallel to the longitudinal axis of said vacuum jacket, said guiding means comprising a plurality of first guide elements projecting from said blast jacket toward said vacuum jacket, said first guide elements being circumferentially spaced from one another, and a plurality of second guide elements projecting from said vacuum jacket toward said blast jacket, said second guide elements being circumferentially spaced from one another.

10. In combination, an element projecting from a larger surface, said element having sides to be cleaned; and a blast head for a vacuum-blasting machine for cleaning said sides of the element, the blast-head comprising a vacuum jacket for engaging the surface from which said element projects, said vacuum jacket being connected to a vacuum source to conduct particles away from the surface;

a blast jacket positioned within said vacuum jacket, said blast jacket having an open end for receiving the projecting elements;

means for sending particles under pressure in a predetermined general direction through said blast jacket and into engagement with the projecting elements; and means for directing particles under pressure against said sides of said projecting element, said sides lying generally parallel to the predetermined general direction in which particles are sent through the blast jacket.

11. The combination of claim 10, wherein said directing means comprises a deflection surface oriented at an angle to said predetermined general direction in which particles are sent under pressure.

12. The combination of claim 11, wherein said deflection surface is an annular surface positioned at the open end of said blast jacket.

13. The combination of claim 11, wherein said blast jacket defines a longitudinal axis, and said deflection surface lies at a 45° angle with respect to said longitudinal axis.

14. The combination of claim 11, wherein said deflection surface is made of tungsten carbide.

15. The combination of claim 11, wherein said deflection surface is made of boron carbide.

16. The combination of claim 10, wherein said projecting element is within said blast jacket.

17. The combination of claim 11, wherein said deflection surface is in alignment with said projecting element in a direction transverse to the predetermined general direction in which particles are sent through the blast jacket.

* * * * *